United States Patent [19]

Cristea

[11] Patent Number: 4,883,422

[45] Date of Patent: Nov. 28, 1989

[54] MIXED AIR AND GAS NOZZLE FOR GAS BURNERS, IN PARTICULAR BURNERS OF LOW THERMAL OUTPUT FOR FIRING KILNS

[75] Inventor: Eugen D. Cristea, Zibido S. Giacomo, Italy

[73] Assignee: T.T.C. Termo Tecnica Ceramica S.P.A., Modena, Italy

[21] Appl. No.: 333,614

[22] Filed: Apr. 5, 1989

[30] Foreign Application Priority Data

Apr. 5, 1988 [IT] Italy ..... 46826 A/88

[51] Int. Cl.[4] ..... F23M 9/00

[52] U.S. Cl. ..... 431/182; 431/185; 431/187; 431/353

[58] Field of Search ..... 431/181, 173, 182, 187, 431/188, 353, 185; 239/406, 424, 424.5

[56] References Cited

U.S. PATENT DOCUMENTS 2,368,370 1/1945 Maxon ..... 431/187
4,261,518 4/1981 Russell ..... 239/424.5
4,690,635 9/1987 Coppin ..... 431/187
4,728,284 3/1988 Coppin ..... 431/182

*Primary Examiner*—Margaret A. Focarino
*Attorney, Agent, or Firm*—Birch, Stewart, Kolasch & Birch

[57] ABSTRACT

The nozzle comprises an axial chamber (23) provided in a first part (21) and into which the fuel gas is fed, and a chamber (24) which surrounds the chamber (23) and into which air is fed; the two chambers (23) and (24) are separated from the combustion chamber (4) by a front plate (5) in which three series of apertures are provided, namely a series of peripheral apertures (31) arranged to pass secondary air with a velocity having an axial and tangential component, a second series of apertures (32) disposed on a more inner circumference and arranged to pass primary air and also having an axial and possibly also tangential component, and a third series of more central apertures arranged to pass gas; by virtue of said apertures the burner thermal output is adjustable to the extent of enabling it to be varied within a very wide range of values.

5 Claims, 2 Drawing Sheets

MIXED AIR AND GAS NOZZLE FOR GAS BURNERS, IN PARTICULAR BURNERS OF LOW THERMAL OUTPUT FOR FIRING KILNS

This invention relates to gas burners, particularly of low thermal output, ie having a rated thermal output of 30–60 kilowatts (thermal), in particular for firing kilns.

For this purpose mixed air and gas nozzles are already known for application to a longitudinally extending combustion chamber, they comprising a first part and a second part associated with each other and fixed together in such a manner as to define a first central axial chamber and a second toroidal chamber which surrounds and is coaxial to the first chamber.

The first chamber is fixed with pressurised fuel gas and the second chamber is fed with pressurised air.

These chambers are separated from the combustion chamber by a circular front plate which closes the initial circular section of the combustion chamber.

Air enters the second chamber and from there flows into the combustion chamber through a series of circular holes provided in an axial direction in the front plate, whereas the gas enters the first chamber and from there flows into the combustion chamber through a series of smaller central holes extending in directions having an axial and radial component.

The gas and air mix in a first shorter cylindrical chamber which acts as the mixing chamber, to then burn in a subsequent combustion chamber.

In said burners the thermal output can be varied by varying the fuel gas throughput while at the same time varying the air in the same proportion (adjustment with proportional air throughput), for values variable from one to two times the thermal output at minimum working.

Beyond these values the burner nozzle or at least the first part carrying the front plate has to be changed, in order to change the dimensions of the holes in the plate.

In addition, in said burners it is not possible to vary the thermal output by varying the fuel gas throughput while keeping the air throughput fixed (adjustment with fixed air throughput).

However, in many applications it would be advantageous if burners were available having a wider range of thermal output adjustment with proportional air throughput, and with the possibility of implementing adjustment with fixed air throughput.

This is so for example in the case of tile firing kilns of the single-layer type in which different heating zones are provided, namely an initial preheating zone, a central firing zone, and a final cooling zone.

In this respect, because of different heating characteristics and requirements in the different zones, in such kilns it would be advantageous to have in the initial and final zones burners working with variable thermal output at fixed air throughput, and in the central zone burners working with a widely variable thermal output at proportional air throughput.

The object of the present invention is to provide a nozzle for the described type of burner which, for the same nozzle, is able to allow a greater range of adjustment with proportional air throughput and a good range of adjustment with fixed air throughput.

Said object is attained by the invention as characterised in the claims.

It has been found experimentally that using the same nozzle, the present invention allows the thermal output to be varied within a range of values variable from 1 to 6 with proportional air throughput and from 1 to 4 with fixed air throughput.

The invention is described in detail hereinafter with reference to the accompanying figures which illustrate one embodiment thereof.

Figure 1:
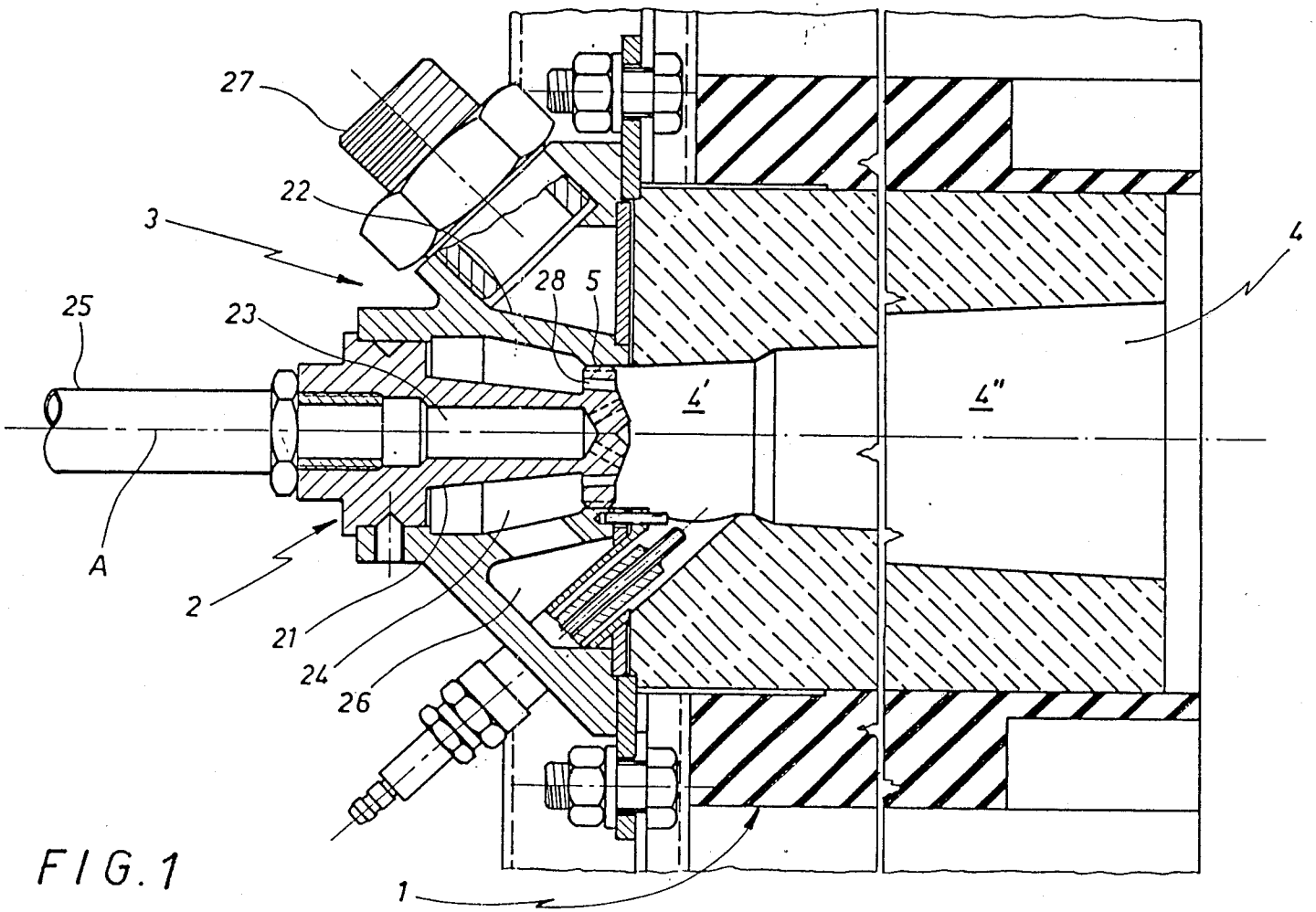
FIG. 1 shows a burner of known type in which the nozzle according to the invention is inserted.
Figure 3:
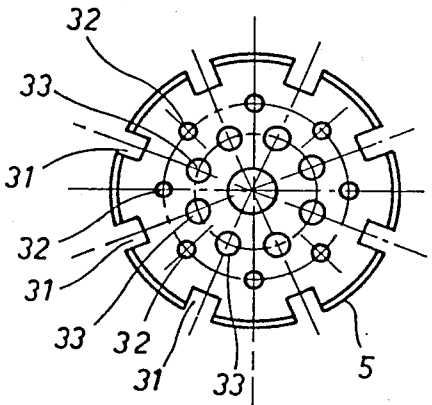
FIG. 3 is a frontal view from right to left of the front plate of FIG. 2.
Figure 4:
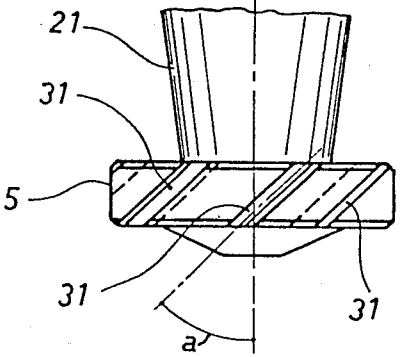
FIG. 4 is a side view of the front plate of FIG. 3.
Figure 2:
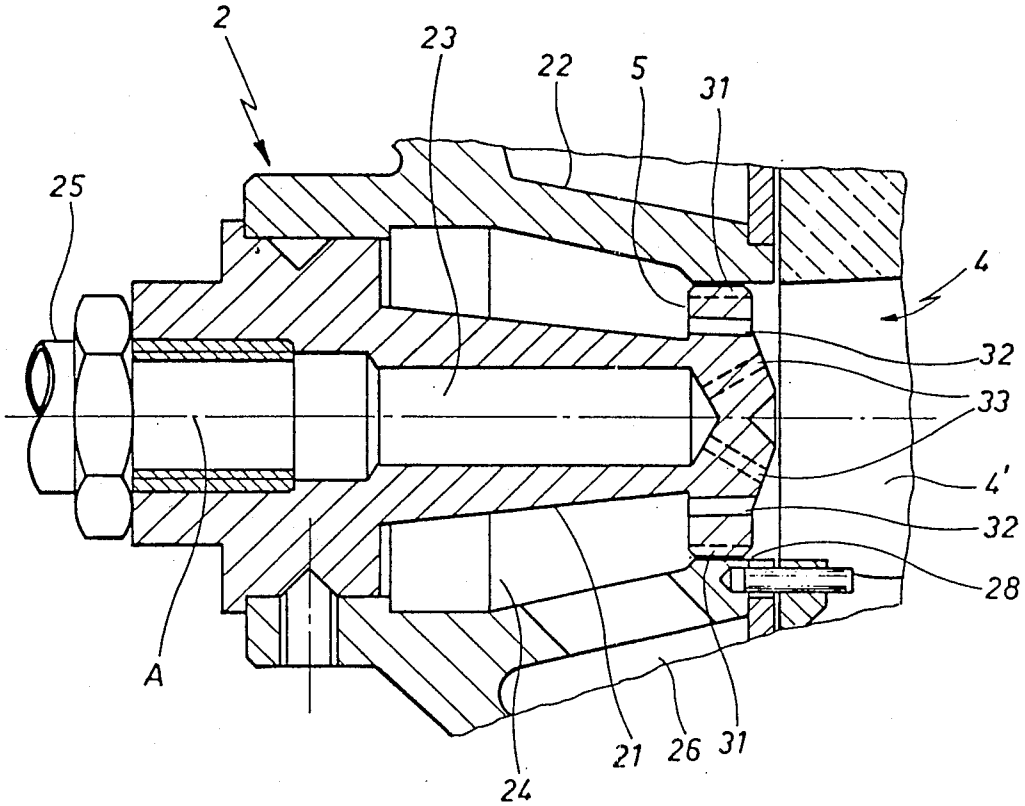
FIG. 2 shows the nozzle of FIG. 1 to an enlarged scale.

In said figures the reference numeral 1 indicates an equipment portion (for example of a firing kiln) to which the burner 3 comprising the nozzle 2 according to the invention is applied.

The nozzle 2 is applied to an axially elongated combustion chamber 4 composed specifically of a mixing chamber 4' of cylindrical shape and an actual combustion chamber 4'' which axially follows the chamber 4' and is of slightly frusto-conical shape with a length somewhat greater than the chamber 4'.

The nozzle 2 comprises a first part 21 and a second part 22, the part 21 being disposed within and connected to the part 22.

Within the part 21 there is provided a first substantially cylindrical elongated axial chamber 23 on the same axis A as the combustion chamber 4. In addition, said chamber 23 communicates by way of a pipe 25 with known fuel gas feed means (not shown).

Between the two parts 21 and 22 there is defined a second toroidal chamber 24 which surrounds and is coaxial to the first chamber 23. In particular, the chamber 24 converges slightly towards the chamber 4.

The chamber 24 communicates with an annular chamber 26 provided within the burner and communicating with known air feed means by way of a connection mouth 27.

The chambers 23 and 24 are separated from the combustion chamber 4 by a circular front plate 5 which closes the initial section of the chamber 4, and in particular of the chamber 4'.

The part 22 comprises an inner cavity converging slightly towards its inner mouth 28 which mates with the initial section of the chamber 4', and internally containing the part 21.

The part 21 comprises a front plate 5 which closes the inner mouth 28 of the part 22, and a slightly frusto-conical middle portion of diameter less than the plate 5 and less than the most outer portion of the part 22. The chamber 24 is defined between this middle portion and the cavity of the part 22.

The plate 5 comprises a first series of apertures 31 for communication between the chamber 24 and the combustion chamber 4, and provided on the periphery of the plate, with their axes lying on one and the same (ideal) cylindrical surface coaxial to the chamber 4 and being inclined tangentially in the same direction by an angle (indicated by a in the figures) of about 30–60 degrees to the generators of the cylindrical surface.

In other words the directions of the axes of the apertures 31 have a tangential component (ie tangential to a circumference lying in a plane orthogonal to the axis A and centered on this axis) and an axial component, the angle which the axes form with the axial direction being said angle a.

Specifically, the apertures 31 consist of channels of rectangular cross-section formed on the periphery of the plate 5, their fourth side being defined by the surface of the mouth 28.

The plate 5 also comprises a second series of apertures 32 providing communication between the chamber 24 and the combustion chamber 4, and disposed on one and the same circumference concentric to said plate and inward of the periphery thereof. The axes of the apertures 32 lie substantially on one and the same (ideal) cylindrical surface and are inclined tangentially, in the direction in which the apertures 31 are inclined, by an angle of about 0–60 degrees to the generators of the cylindrical surface.

In other words the directions of axes of the apertures 32 have an axial component and possibly a tangential component.

The plate 5 also comprises a third series of apertures 33 providing communication between the chamber 23 and the chamber 4 and disposed a shorter distance from the center of the plate 5 than the apertures 32. The axes of the apertures 33 are substantially parallel to the axis A of the chamber 4 or are inclined by a small radial component.

Specifically, the apertures 32 and 33 consist of through cylindrical holes.

The proportion of the primary air throughput passing through the apertures 32 to the total air throughput passing through the apertures 31 and 32 varies between 15% and 30%.

From experiments carried out it has been found that good results are obtained by a nozzle in which the angle of inclination a of the apertures 31 is about 45 degrees and in which the apertures 32 have a purely axial direction.

The first series of apertures 31 is preferably disposed on radii of the plate 5 which are offset from and alternate with the radii on which the second series of apertures 32 is disposed. In other words, each aperture 31 is radially adjacent to a zone intermediate between two apertures 32 and vice versa.

Likewise, the apertures 32 are preferably disposed on radii offset from the radii on which the apertures 33 are disposed.

Most of the air (secondary air) passes through the apertures 31 to enter the mixing chamber 4 with a tangential velocity component which produces helical swirling motion.

This motion is very important and together with the air passing through the holes 32 (primary air) produces very efficient mixing of the air and gas. In addition a very effective rearward attraction of very hot gas is obtained, drawn from the chamber 4'' and into the chamber 4' in the central zone of the flame, this fact being very important as it effectively increases flame stability.

It has been found in practice that by virtue of said characteristics the nozzle 2 enables the aforesaid wide thermal output adjustment ranges to be obtained for the burner.

What is claimed is:

1. A mixed air and gas nozzle for gas burners, particularly burners of low thermal output for firing kilns, the nozzle being applied to an axially elongated combustion chamber and of the type comprising:

a first part (21) and a second part (22), of which the first is inserted into and coupled to the interior of the second and is coaxial thereto;

a first elongated axial chamber (23) provided in the first part (21) coaxial to the combustion chamber and communicating with gas feed means;

a second chamber (24) coaxially surrounding the first chamber (23) and provided between said first and second part (21) and (22) and communicating with air feed means; said first and second chamber (23) and (24) being separated from the combustion chamber (4) by a circular front plate (5) which closes the initial circular section of the combustion chamber; characterised in that said front plate comprises:

a first series of apertures (31) providing communication between the second chamber (24) and the combustion chamber and disposed on the periphery of the front plate (5) such that their axes lie substantially on one and the same cylindrical surface coaxial to the combustion chamber (4) and are inclined tangentially in the same direction by an angle of about 30–60 degrees to the generators; of the cylindrical surface a second series of apertures (32) providing communication between the second chamber (24) and the combustion chamber and disposed on one and the same circumference concentric to but inward of the periphery of the front plate (5);

a third series of apertures (33) providing communication between the first chamber (23) and the combustion chamber and disposed a shorter distance from the center of the plate (5) than the second apertures (32); the proportion of air throughput passing through the second apertures to the total air throughput passing through the apertures (31) and (32) being between 15% and 30%.

2. A nozzle as claimed in claim 1, characterised in that the axes of the second apertures (32) lie substantially on one and the same cylindrical surface and are inclined tangentially in the same direction as the axes of the first apertures (31) by an angle of about 0–60 degrees to the generating line of the cylindrical surface.

3. A nozzle as claimed in claim 2, characterised in that:

said angle of inclination of the first series of apertures (31) is about 45 degrees;

said angle of inclination of the second series apertures is about 0 degrees.

4. A nozzle as claimed in claim 1, characterised in that the first series of apertures (31) is disposed on radii of the front plate (5) which are offset from and alternate with the radii on which the second series of apertures (32) is disposed.

5. A nozzle as claimed in claim 1, characterised in that said front plate (5) is an integral part of the first part (21) and is arranged to close the inner mouth (28) of the second chamber (24).

* * * * *